US006176611B1

(12) United States Patent
Schushan et al.

(10) Patent No.: US 6,176,611 B1
(45) **Date of Patent: *Jan. 23, 2001**

(54) SYSTEM AND METHOD FOR REDUCING POWER CONSUMPTION IN WAITING MODE

(75) Inventors: Asaf Schushan, Ramat Hasharon; Yona Leshets, Zur Igai, both of (IL)

(73) Assignee: D.S.P.C. Technologies Ltd., Giv'at Shmuel (IL)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/906,089

(22) Filed: Aug. 5, 1997

(51) Int. Cl.[7] ..... G04B 17/20

(52) U.S. Cl. ..... 368/202; 368/119; 368/66; 368/203; 368/10

(58) Field of Search ..... 368/201, 202, 368/119, 118, 120, 66, 10, 203, 204

(56) References Cited

U.S. PATENT DOCUMENTS 4,264,967 * 4/1981 Fujita et al. ..... 368/156
5,224,152 6/1993 Harte .
5,357,490 * 10/1994 Kashine ..... 398/119
5,416,435 * 5/1995 Jokinen et al. ..... 368/200
5,428,638 6/1995 Cioffi et al. .
5,444,672 * 8/1995 Kushita ..... 368/47
5,568,513 10/1996 Croft et al. .
5,596,571 1/1997 Gould et al. .

OTHER PUBLICATIONS

CDMA ASIC Products Data Book, 80–22370–2 A, pp. 3–4 to 3–5 (2 pages total) Feb. 1998.

* cited by examiner

*Primary Examiner*—Bernard Roskoski
(74) *Attorney, Agent, or Firm*—McDermott, Will & Emery

(57) ABSTRACT

A timer for measuring a time period including a high frequency generating unit, a low frequency generating unit and a controller connected to the high and low frequency generating units, wherein the controller deactivates the high frequency generating unit during at least a portion of the time period, detects and counts predetermined portions of the signals provided by the high and low frequency generating units and counts a plurality of the portions of the currently active frequency generating unit.

9 Claims, 8 Drawing Sheets

SYSTEM AND METHOD FOR REDUCING POWER CONSUMPTION IN WAITING MODE

FIELD OF THE INVENTION

The present invention relates to a method and system for low power precision timing, in general and to a method and a device for providing improved power consumption, while maintaining precise timing, of a communication system in waiting mode, in particular.

BACKGROUND OF THE INVENTION

Methods and devices for providing precise timing and precise time counting are known in the art. Such devices conventionally include a crystal for providing a basic frequency and a controller for accumulating the clock signals generated by the crystal. When such a system attempts to increase the accuracy of the counting mechanism, it utilizes a high frequency crystal which increases the resolution in time.

It would be appreciated that frequency and energy are associated in a way that producing a higher frequency requires higher power to be provided thereto. The basic quantum rule is presented by the expression:

$$E=h\cdot f$$

wherein E represents energy, h represents Planck's coefficient and f represents frequency.

In CMOS design, the following expression is used:

$$P=C\cdot V^2\cdot f$$

wherein P represents power, C represents capacity and V represents voltage.

Methods for managing power of a communication system in waiting mode are known in the art. A conventional communication system, in waiting mode has to detect hailing signals and open a communication channel when it detects a hailing signal which is addressed thereto.

Conventional communication protocols, such as TDMA, determine time periods in which hailing signals are transmitted. State of the art communication systems, attempt to shut down their receiver, when out of these time periods, so as to save power. Such systems are described in U.S. Pat. No. 5,568,513 to Croft et al and U.S. Pat. No. 5,224,152 to Harte.

SUMMARY OF THE PRESENT INVENTION

It is an object of the present invention to provide a novel method and device for reducing power consumption of a communication unit in waiting mode.

It is a further object of the present invention to provide a novel method and system for low powered timing.

According to the present invention there is thus provided a timer for measuring a time period including a high frequency generating unit, a low frequency generating unit and a controller connected to the high and low frequency generating units. The controller deactivates the high frequency generating unit during at least a portion of the time period. The controller further detects and counts predetermined portions of the signals provided by the high and low frequency generating units. Furthermore, the controller counts a plurality of the portions of the currently active frequency generating unit.

The timer can also include means, connected to the controller, for estimating the frequency of the low frequency generating unit.

According to another aspect of the present invention, there is provided a method for providing an indication of a time period T which commences at time $t_1$ and expires at time $t_2$. the method including the steps of:

activating a high timing level at time $t_1$;

counting a first predetermined number M of predetermined cycle portions of the high timing level for determining a first partial time period;

activating a low timing level at the end of the first partial time period; and counting a second predetermined number N of predetermined cycle portions of the low timing level.

According to the invention, the method can further include a step of indicating the expiration of the time period at time $t_2$.

For example, the first predetermined number M and the second predetermined number N satisfy the following equation:

$$T=N\times T_L+M\times T_H$$

wherein $T_H$ represents a time period determined by the predetermined cycle portions of the high timing level and $T_L$ represents a time period determined by the predetermined cycle portions of the low timing level.

The method of the invention, can further include a step of deactivating the high timing level after the step of activating the low timing level.

For further accuracy, the method of the present invention, can further include a step of estimating the frequency of the low timing level.

According to a further aspect of the present invention, there is provided a communication system which includes a receiver, and a timer for measuring a time period. The timer includes a high frequency generating unit, a low frequency generating unit and a controller connected to the high and low frequency generating units. The controller is further connected to the receiver.

The controller deactivates the high frequency generating unit during at least a portion of the time period, deactivates the receiver during at least another portion of the time period, detects and counts predetermined portions of the signals provided by the high and low frequency generating units and counts a plurality of the portions of the currently active frequency generating unit.

The communication system of the invention, can further include means, connected to the controller and to the receiver, for estimating the frequency of the low frequency generating unit.

BRIEF DESCRIPTION OF THE DRAWINGS

The present invention will be understood and appreciated more fully from the following detailed description taken in conjunction with the drawings in which.

DETAILED DESCRIPTION OF PREFERRED EMBODIMENTS

The present invention overcomes the disadvantages of the prior art by providing a timing mechanism which includes two levels of timing.

A high timing level, which provides high resolution timing and a low timing level which provides low timing resolution, combined with a low power consumption. The combination of these two timing levels, according to the invention, reduces power consumption significantly.

Figure 1:
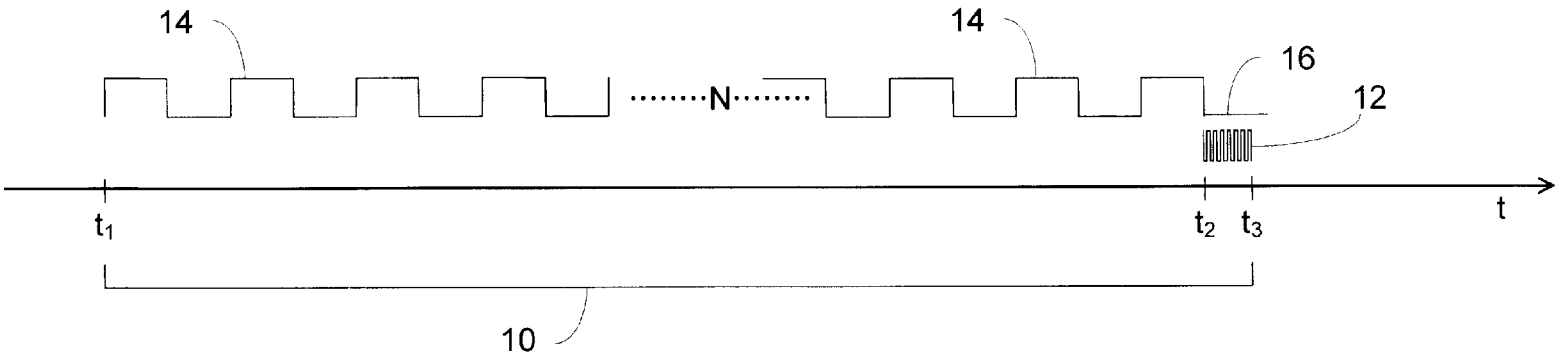
FIG. 1 is a schematic illustration of a timing diagram of two timing levels, in accordance with a preferred embodiment of the present invention.

Reference is now made to FIG. 1, which is a schematic illustration of a timing diagram of two timing levels, in accordance with a preferred embodiment of the present invention.

Time period 10, from $t_1$ to $t_3$, represents a predetermined time period which needs to be counted and indicated. Timing level 12 is a high frequency timing level. Timing level 14 is a precise low frequency timing level. Maintaining timing level 12 requires more power than maintaining timing level 14.

Time period 10 can not be represented by a natural number of half cycles of the low timing level 14. When $t_1$ is aligned with the rising point of the first cycle of the low timing level 14 then, $t_3$ occurs within the last cycle 16 of low timing level 14.

$t_3$ does not align with either a rise or a fall of a cycle of the low timing level 14. Thus, the low timing level 14 can not be used to indicate $t_3$. It will be appreciated that time period 10 can be represented by the expression:

$$T=N\times T_L+M\times T_H$$

wherein T represents time period 10, $T_H$ represents half of a single cycle of the high timing level, $T_L$ represents half of a single cycle of the low timing level and M and N are natural numbers.

It will be appreciated that conventional oscillators (and for that matter, crystal) incorporate an error. Accordingly, the $T_H$ and $T_L$ have errors $\Delta T_H$ and $\Delta T_L$, respectively. Thus, N and M are evaluated according to these errors so that $$|T-(N\times T_L+M\times T_H)|\leqq\Delta T$$

wherein $\Delta T$ is a maximal predetermined error of time period T.

$t_2$ represents a point in time where the low timing level 14 has the last rise or fall. This occurs before $t_3$. At $t_2$, the high timing level 12 is activated and the low timing level 14 is deactivated. Then, the high timing level 12 counts the time period from $t_2$ to $t_3$ and provides an indication of $t_3$.

Accordingly, the present invention provides high resolution timing mechanism, using a combination low timing level and high timing level, wherein the overall resolution is determined according to the resolution of the high timing level.

Figure 2:
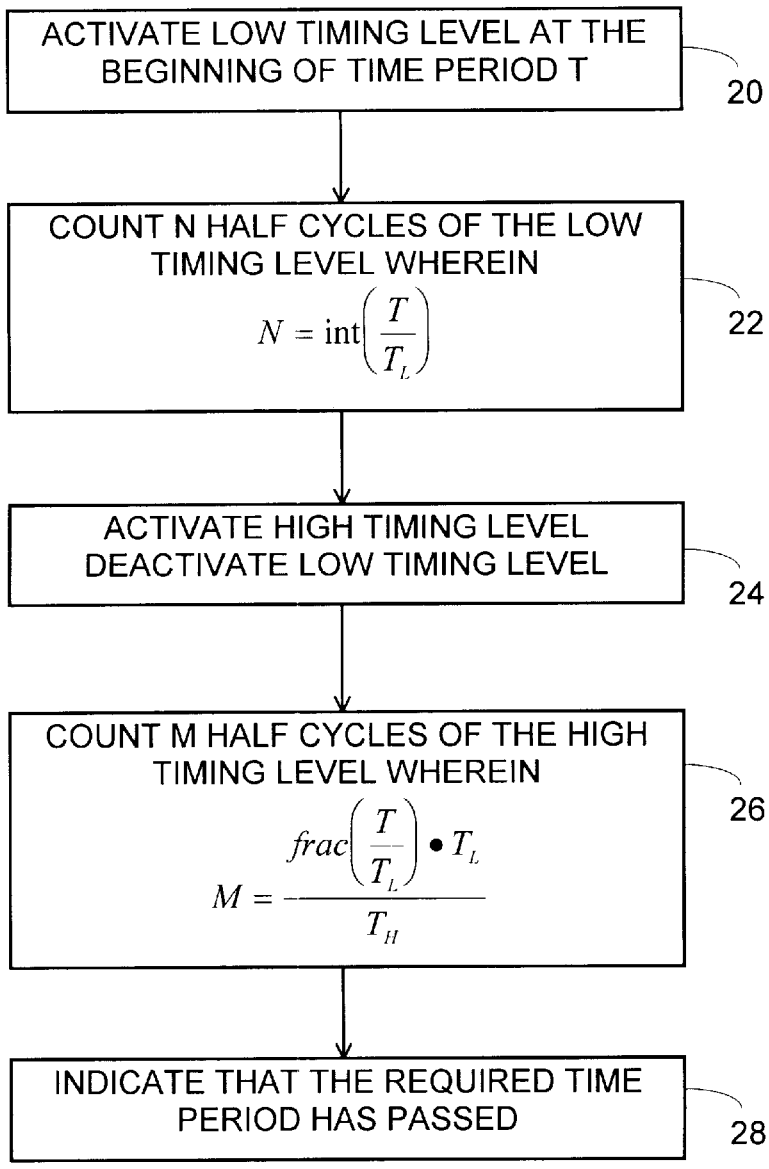
FIG. 2 is a schematic illustration of a method for providing a time count of a predetermined time period T using the two timing levels of FIG. 1, in accordance with a further preferred embodiment of the present invention.

Reference is now made to FIG. 2, which is a schematic illustration of a method for providing a time count of a predetermined time period T using the two timing levels of FIG. 1, in accordance with a further preferred embodiment of the present invention.

In step 20, the low timing 14 is activated at the beginning of time period T.

In step 22, N half cycles of the low timing level are counted, wherein $$N = int\left(\frac{T}{T_L}\right).$$

Right after these N half cycles, the high timing level 12 is activated and the low timing level 14 is deactivated (step 24).

In step 26, M half cycles of the high timing level are counted, wherein $$M = \frac{frac\left(\frac{T}{T_L}\right)\cdot T_L}{T_H}.$$

In step 28, the end of time period T is indicated.

Figure 3:
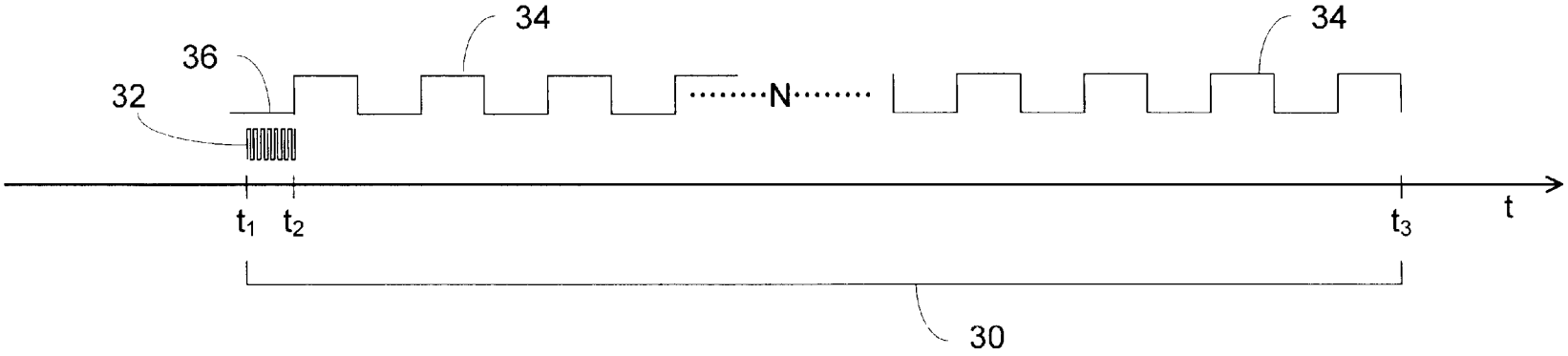
FIG. 3 is a schematic illustration of a timing diagram of two timing levels, in accordance with another preferred embodiment of the present invention.

Reference is now made to FIG. 3, which is a schematic illustration of a timing diagram of two timing levels, in accordance with another preferred embodiment of the present invention.

Time period 30, from $t_1$ to $t_3$, represents a predetermined time period which needs to be counted and indicated. Timing level 32 is a high frequency timing level. Timing level 34 is a precise low frequency timing level. Maintaining timing level 32 requires more power than maintaining timing level 34.

Time period 30 can not be represented by a natural number of half cycles of the low timing level 34. When $t_3$ is aligned with the rising point of the first cycle of the low timing level 34, then $t_1$ occurs within a cycle 36 of low timing level 34. $t_1$ does not align with either a rise or a fall of a cycle of the low timing level 34. Thus, the low timing level 34 can not be used to indicate $t_3$.

$t_2$ represents a point in time where the low timing level 34 has the first rise or fall after $t_1$. The time period from $t_2$ to $t_3$ can be represented by a natural number of half cycles of the low timing level 34.

At $t_2$, the low timing level 34 is activated and the high timing level 32 is deactivated. Then, the low timing level 34 counts the time period from $t_2$ to $t_3$ and provides an indication of $t_3$.

Figure 4:
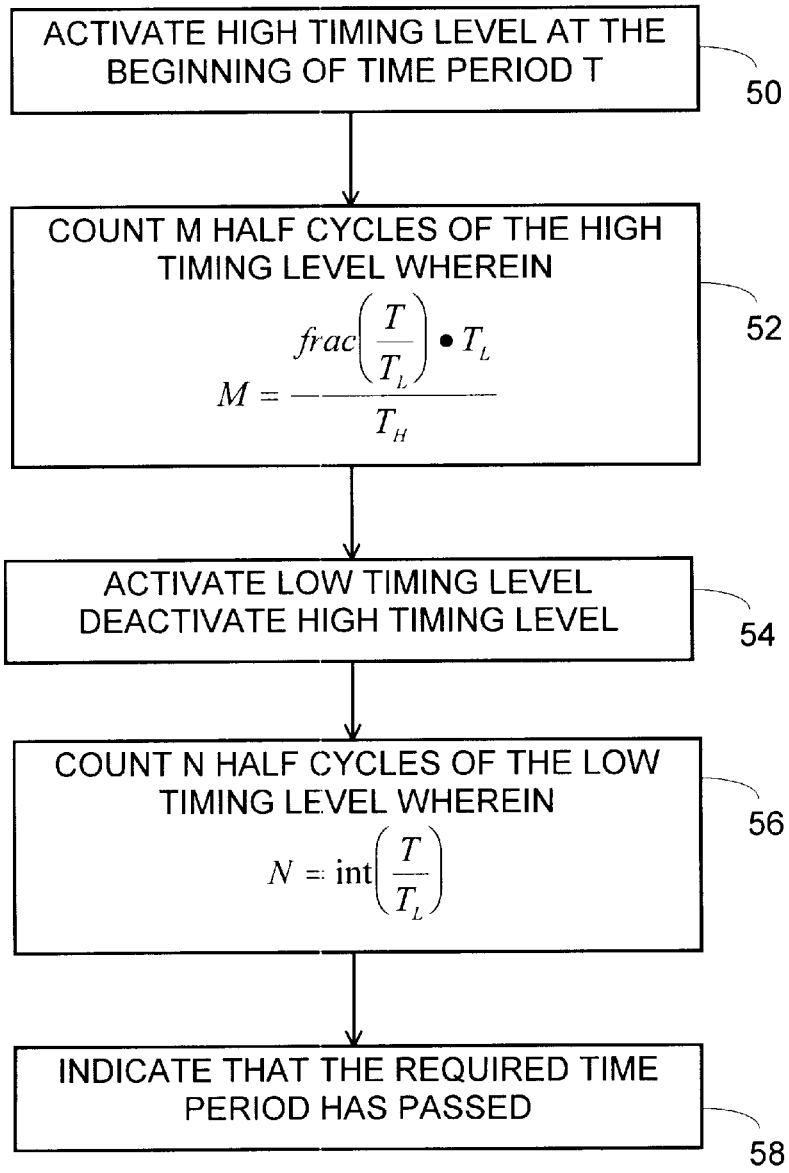
FIG. 4 is a schematic illustration of a method for providing a time count of a predetermined time period T using the two timing levels of FIG. 3, in accordance with another preferred embodiment of the present invention.

Reference is now made to FIG. 4, which is a schematic illustration of a method for providing a time count of a predetermined time period T using the two timing levels of FIG. 3, in accordance with another preferred embodiment of the present invention.

In step 50, the high timing level 32 is activated at the beginning of time period T.

In step 52, M half cycles of the high timing level are counted, wherein $$M = \frac{frac\left(\frac{T}{T_L}\right) \cdot T_L}{T_H}.$$

Right after these M half cycles, the low timing level 34 is activated and the high timing level 32 is deactivated (step 54).

In step 56, N half cycles of the low timing level are counted, wherein $$N = int\left(\frac{T}{T_L}\right).$$

In step 58, the end of time period T is indicated.

Some oscillators, after they are activated, require at least a predetermined period of time to stabilize, before they can produce a constant stable frequency signal. Accordingly, the present invention provides a solution which enables utilizing such oscillators.

Figure 5:
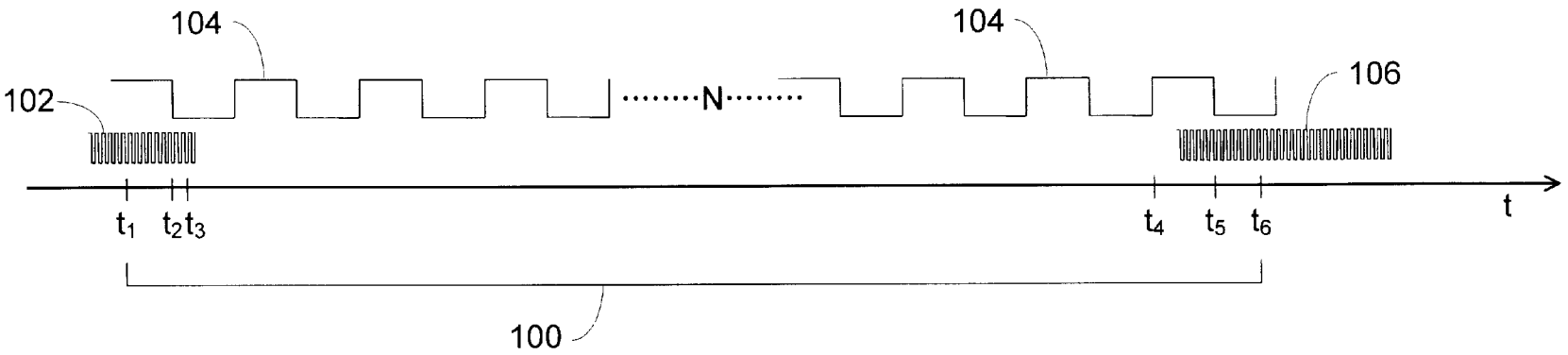
FIG. 5 is a schematic illustration of a timing diagram of two timing levels, in accordance with yet another preferred embodiment of the present invention.

Reference is now made to FIG. 5, which is a schematic illustration of a timing diagram of two timing levels, in accordance with a further preferred embodiment of the present invention.

Time period 100, from $t_1$ to $t_6$, represents a predetermined time period which needs to be counted and indicated. Timing level 102 is a high frequency timing level. Timing level 104 is a precise low frequency timing level. Maintaining timing level 102 requires more power than maintaining timing level 104.

According to the invention, once $t_1$ is detected, using high timing level 102, then, the low timing level 104 is activated. $t_2$ represents a point in time where the high timing level 102 and the low timing level 104 align, after which the high timing level 102 can be deactivated. Accordingly, the high timing level 102 is deactivated at time point $t_3$. The time period from $t_1$ to $t_2$ is represented by $M_1$ half cycles of the high timing level.

According to the present example, $t_6$ occurs within a cycle of the low timing level 104. Accordingly, the low timing level 104 can not indicate $t_6$ with sufficient accuracy.

Low timing level 104 counts a time period from $t_2$ to $t_4$, at low power consumption. At $t_4$, after the low timing level 104 has counted a predetermined number of half cycles N, then, the high timing level 106 is reactivated. It will be appreciated by those skilled in the art that conventionally, when a crystal oscillator is activated, it requires some time to stabilize thereby producing a constant frequency, as required.

$t_5$ represents a point in time in which the high timing level 106 and the low timing level align. The low timing level 104 can be deactivated after $t_5$.

Then, the high timing level 102 counts $M_2$ half cycles, after which, the end of time period 100 can be indicated.

Time period 100 can be represented by the expression:

$$T=N\times T_L+(M_1+M_2)\times T_H$$

wherein T represents time period 100, $T_H$ represents half of a single cycle of the high timing level, $T_L$ represents half of a single cycle of the low timing level and $M_1$, $M_2$ and N are natural numbers.

Figure 6:
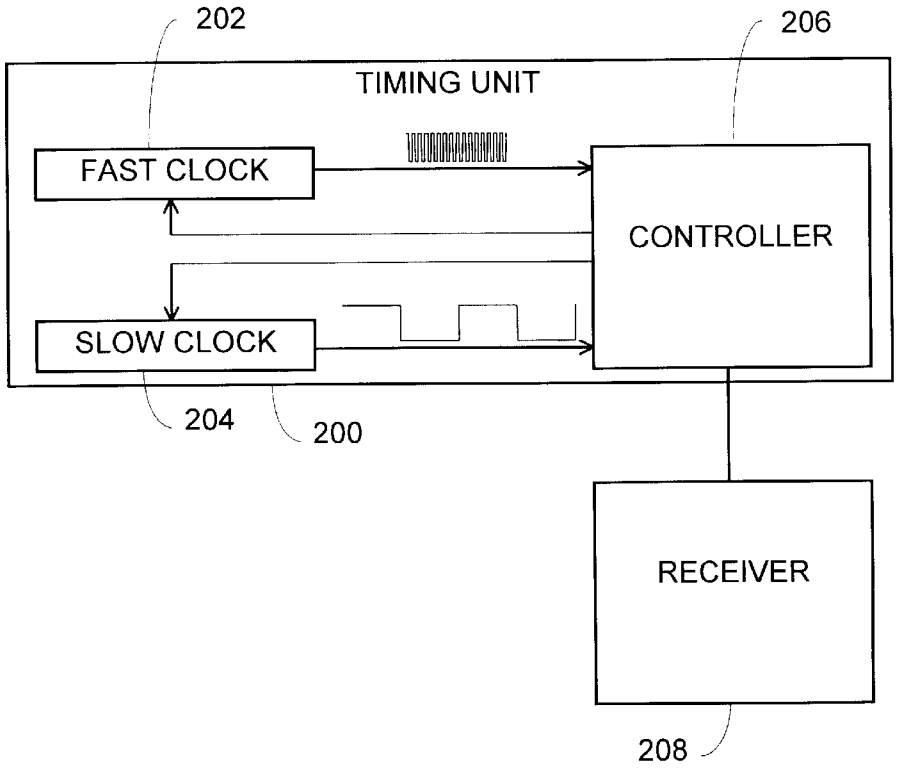
FIG. 6 is a schematic illustration of a timing system, constructed and operative in accordance with another preferred embodiment of the present invention.

Reference is made now to FIG. 6 which is a schematic illustration of a timing system, generally referenced 200, constructed and operative in accordance with another preferred embodiment of the present invention.

System 200 includes a fast clock 202, for producing a high frequency, a slow clock 204, for producing a low frequency and a controller 206, connected to the fast clock 202 and the slow clock 204.

The controller 206 controls each of the clocks 202 and 204 so as to activate, deactivate, count and moderate them. The controller 206 is also connected to a receiver 208. The controller 206 provides the receiver timing frequencies. In the present example, the controller 206 is also capable of activating, deactivating, enabling and disabling the receiver 208.

Figure 7:
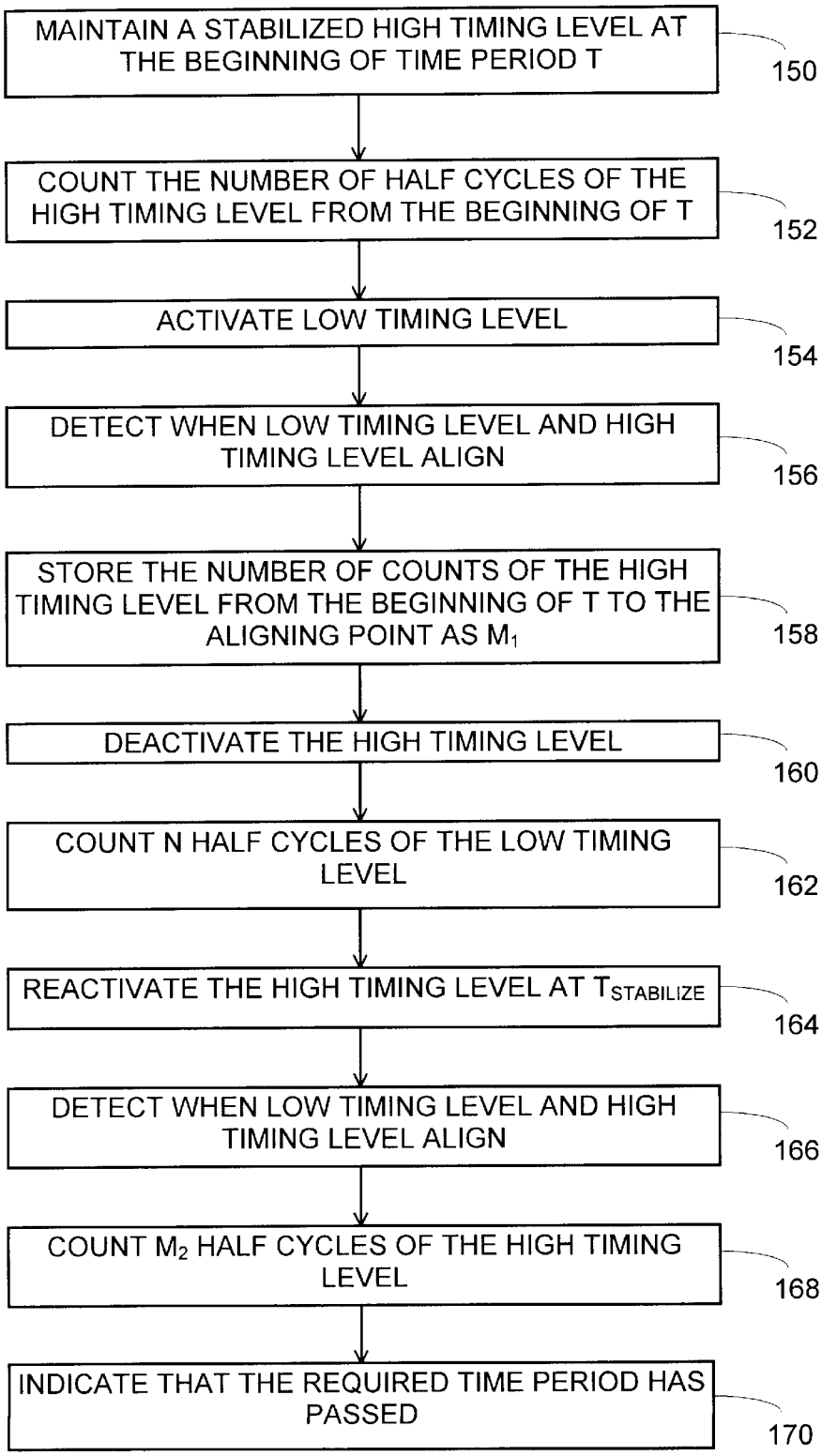
FIG. 7 is a schematic illustration of a method for operating the system of FIG. 6, providing a time count of a predetermined time period T using the two timing levels of FIG. 5, operative in accordance with another preferred embodiment of the present invention.

Reference is also made to FIG. 7, which is a schematic illustration of a method for operating the system 200 of FIG. 6, providing a time count of a predetermined time period T using the two timing levels of FIG. 5, in accordance with another preferred embodiment of the present invention.

In step 150, a high timing level 102 (FIG. 5) is maintained at the beginning ($t_1$) of time period T (time period 100). Then, the controller 206 counts half cycles of the signal provided by the fast clock 202, from $t_1$ (step 152).

In step 154, a low timing level 104 (FIG. 5) is activated. In the present example, the controller 206 activates the slow clock 204 and detects when the signals, provided by the slow clock 204 and the fast clock 202, align (step 156). In the present example $t_2$ of FIG. 5 represents this alignment point. Then, the system 200 stops counting the signal of the fast clock and starts counting the signal of the slow clock.

In step 158, the system 200 stores the number of counts of the fast clock, from $t_1$ to $t_2$, in a variable $M_1$.

In step 160, the high timing level, represented by the fast clock 202, is deactivated. In the present example, the controller 206 shuts down the fast clock 202 at $t_3$. It will be noted that when the power consumption of system 200 is considerably lower when the slow clock 204 is operative than the power consumption achieved when the fast clock 202 is operative. It will be further appreciated that the controller 206 is connected to an external device, such as receiver 208, then, the controller 206 may disable this device or shut it down, for further power consumption decrease.

In step 162, the N half cycles of the low timing level, are counted. In the present example, the controller 206 counts N half cycles of the signal provided by the slow clock 204, according to the expression:

$$N = int\left(\frac{T - M_1 \times T_H}{T_L}\right).$$

In step 164, the high timing level 106 is reactivated at $T_{STABILIZE}$, which is a point in time before N half cycles of the low timing level are completed, required for stabilizing the high timing level. In the present example, the controller 206 reactivates the fast clock 202 at $t_4$.

In step 166, a point in time is detected, where the high timing level 102 and the low timing level 104 align. It will be noted that this point in time should also represent the completion of counting N half cycles of the low timing level. In the present example, the controller 206 detects when the fast clock 202 and the slow clock 204 align ($t_5$).

In step 168, $M_2$ half cycles of the high timing level 106 are counted. In the present example, the controller 206 counts the half cycles of the signal provided by the fast clock 202 according to the expression:

$$M_2 = \frac{frac\left(\frac{T - M_1 \times T_H}{T_L}\right) \cdot T_L}{T_H}.$$

In step 170, after completing the count of $M_2$ high timing level half cycles, the end of the time period T is indicated. In the present example, the controller 206 indicates the end of time period 100 to the receiver 208.

For example, in a cellular TDMA implementation, the slow clock 204 comprises a clock of up to 100 KHz and the fast clock 202 comprises a clock of up to 20 MHz. Such clocks are manufactured and sold by DAISHINKU CORP., a Japanese company which is located in Tokyo and Vectron, a US company, which is located in New-York. It will be noted that any oscillating mechanism is applicable for the present invention.

In TDMA, a hailing signal lasts for about 50 ms and may be detected once every 1 second. A conventional timer would use fast crystal, thereby requiring energy $E_{OLD}$ which is given by the following expression:

$$E_{OLD}=P_{OLD}\cdot T=C\cdot V^2\cdot 2\cdot 10^7\cdot 1 \text{ sec}$$

A timer constructed according to the present invention, would use fast crystal (for example at a frequency of 20 MHz) and a slow crystal (for example at a frequency of 100 KHZ) combination, thereby requiring energy $E_{NEW}$ which is given by the following expression:

$$E_{NEW}=P_{NEW}\cdot T=C\cdot V^2\cdot(2\cdot 10^7\cdot 0.05 \text{ sec}+1\cdot 10^5\cdot 0.95 \text{ sec})$$

Accordingly, the ratio $$\frac{E_{NEW}}{E_{OLD}} < 6\%$$

defines that using a timer constructed and operative, in accordance with the present invention, would decrease the power consumption of a cellular unit, in wait mode, by at least ninety-four percent.

Low frequency crystals are generally susceptible to frequency shifts due to environmental changes with respect to temperature, humidity and the like. In communication implementation of the invention, which will be discussed hereinbelow, the frequency of the low timing level has to be evaluated from time to time.

Accordingly, the receiver 208 provides an indication of the frequency of a received signal, which was originally sent by a referenced station. In cellular communication, such a reference station can be a cellular base station which conventionally comprises a high precision high frequency timing crystal, incorporated in a precise and stable frequency mechanism.

The controller 206 utilizes the reference frequency, provided by the receiver 208, to evaluate the frequency of the low timing level. This process is performed, thoroughly, before the system 200 enters waiting mode and constantly, during this waiting mode, each time that the receiver 208 is activated.

Since, a typical duty cycle of the system takes no more than several seconds, the controller 206 is able to evaluate the frequency of the slow clock 204, with enhanced accuracy.

Figure 8:
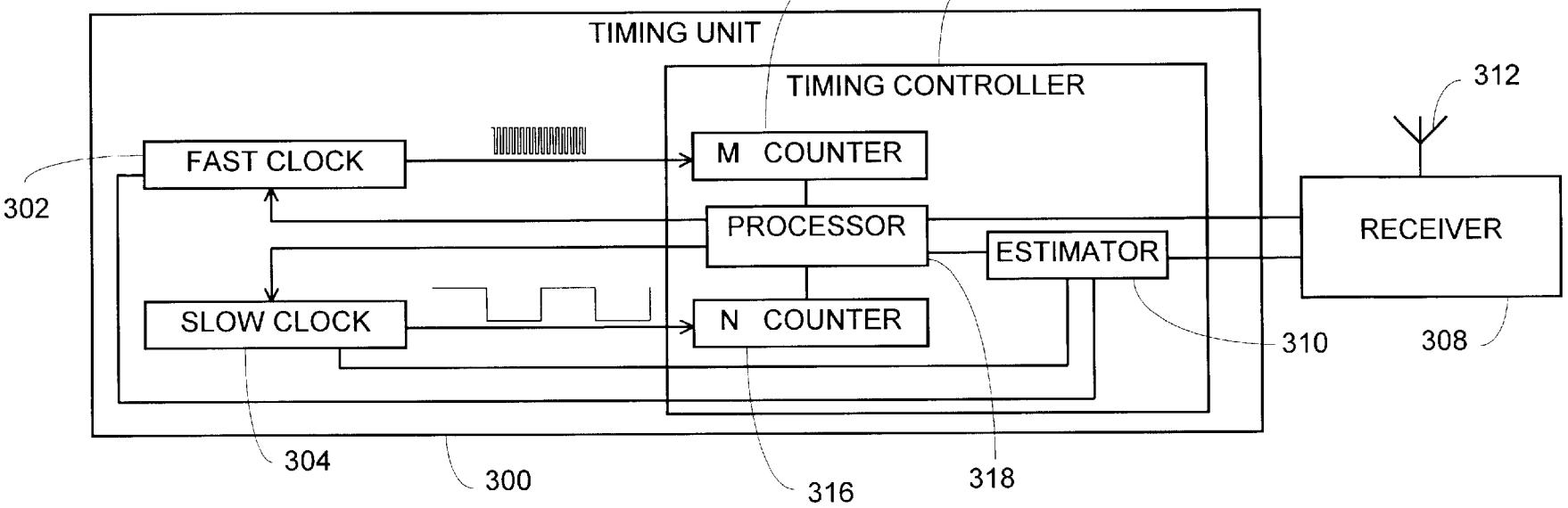
FIG. 8 is a schematic illustration of a timing system, constructed and operative in accordance with a further preferred embodiment of the present invention.

Reference is made now to FIG. 8 which is a schematic illustration of a timing system, generally referenced 300, constructed and operative in accordance with a further preferred embodiment of the present invention.

System 300 includes a fast clock 302, a slow clock 304 and a timing controller 306 which is connected to the fast clock 302 and the slow clock 304. The timing controller 306 includes a processor 318, two counters 314 and 316, which are connected to the processor 318 and an estimator 310, which is connected to the processor 318.

The counter 314 counts portions of the signal provided by the fast clock 302 and is connected thereto. The counter 316 counts portions of the signal provided by the slow clock 304 and is connected thereto.

The estimator 310 is further connected to clocks 302 and 304 and to a receiver 308. The processor 318 is also connected to the receiver 308 and controls it. The receiver 308 receives signals from an antenna 312.

According to the present example, system 300 controls receiver 308, thereby activating, deactivating and supplying it with operating frequency. Furthermore, the system 300 performs timely estimations of the frequencies provided by clocks 302 and 304.

At first, the processor 318 activates the receiver 308. The receiver 308 receives an incoming reference signal from the antenna 312 and provides it to the estimator 310. This signal includes a base frequency which is considerably accurate. The reference signal also includes synchronization data.

The estimator 310 further receives signals from the clocks 302 and 304. Then, the estimator 310 provides frequency estimations to the processor 318 with respect to the frequencies generates by clocks 302 and 304.

The processor 318 calculates values M and N, according to the estimations provided thereto. After the receiver 308 finished receiving the reference signal, the processor 318 employs wait mode thereby deactivating the receiver 308 for a predetermined waiting time period T.

Then the processor 318 operates the fast clock 302 and the slow clock 304, so as to measure this predetermined waiting time period T, according to any of the methods described hereinabove.

After the processor 308 indicated the end of time period T, it reactivates the receiver 318, which in turn receives a short hailing sequence in the above reference frequency. This hailing sequence often includes a synchronization sequence.

According to the present invention, the receiver 308 may provide an indication of the frequency of the reference signal or the signal itself, to the estimator 310, which in turn, utilizes it to re-estimate the frequencies of the clocks 302 and 304 and provides their estimations to the processor 318.

The receiver 308 further provides the synchronization sequence to the processor 318. Then, the processor 318 utilizes the information received from the receiver 308 and the estimator 310 to reassess M and N.

Finally, if the hailing signal did not include an indication of the identity of the receiver 308, then the receiver provides a command to the processor 318, so as to re-enter wait mode.

It will be appreciated that the method of the present invention is applicable to any communication system such as a cellular telephone, a pager, a wireless telephone. In addition, the present invention is also applicable to any device which may require a low power high resolution timer such as computers, calculators, alarm detectors and the like.

It will be appreciated by persons skilled in the art that the present invention is not limited to what has been particularly shown and described hereinabove. Rather the scope of the present invention is defined only by the claims which follow.

What is claimed is:

1. A timer for measuring a timing period comprising:

a high frequency generating unit for generating high frequency oscillating signals;

a low frequency generating unit for generating low frequency oscillating signals; and a controller in operative communication with said high frequency generating unit and said low frequency generating unit, said controller configured such that said high frequency generating unit can operate independently of said low frequency generating unit, said controller configured for deactivating said high frequency generating unit during at least a portion of said timing period, and said controller configured for counting predetermined portions of said high frequency oscillating signals with respect to at least one first transition of said low frequency oscillating signals, said transition defined by either a rise or a fall of a cycle of said low frequency oscillating signals.

2. The timer according to claim 1 further comprising means, connected to said controller, for estimating the frequency of said low frequency generating unit.

3. A method for providing an indication of a time period T which commences at time $t_1$ and expires at time $t_2$, the method comprising the steps of:

activating a high timing level;

counting a first number M of predetermined cycle portions of said high timing level for determining a first partial time period at a first phase; and activating a low timing level at time $t_1$ at a second phase, independent from said first phase, said time $t_1$ defined by the end of said first partial time period; and counting a second predetermined number N of predetermined cycle portions of said high timing level until a first transition of said low timing level, said first transition corresponding to time $t_2$.

4. The method according to claim 3 further comprising the step of indicating the expiration of said time period at time $t_2$.

5. The method according to claim 3 wherein said first predetermined number M and said second predetermined number N satisfy the following equation:

$$T=N\times T_L+M\times T_H$$

wherein $T_H$ represents a time period determined by said predetermined cycle portions of said high timing level and $T_L$ represents a time period determined by said predetermined cycle portions of said low timing level.

6. The method according to claim 3 further comprising the step of deactivating said high timing level after said step of activating said low timing level.

7. The method according to claim 3, further comprising the step of estimating the frequency of said low timing level.

8. A communication system comprising:

a receiver; and a timer for measuring a time period comprising:

a high frequency generating unit for generating high frequency oscillating signals;

a low frequency generating unit for generating low frequency oscillating signals; and a controller in operative communication with said receiver and said high frequency generating unit and said low frequency generating unit, said controller configured such that said high frequency generating unit can operate independently of said low frequency generating unit, said controller configured for deactivating said high frequency generating unit during at least a portion of said time period, said controller configured for deactivating said receiver during at least another portion of said time period, and said controller configured for counting predetermined portions of the high frequency oscillating signals with respect to at least one first transition of said low frequency oscillating signals, said transition defined by either a rise or a fall of a cycle of said low frequency oscillating signals.

9. The communication system according to claim 8 further comprising means, connected to said controller and to said receiver, for estimating the frequency of said low frequency generating unit.

* * * * *

UNITED STATES PATENT AND TRADEMARK OFFICE

CERTIFICATE OF CORRECTION

PATENT NO. : 6,176,611 B1 
DATED : January 23, 2001
INVENTOR(S) : Asaf Schushan et al.

It is certified that error appears in the above-identified patent and that said Letters Patent is hereby corrected as shown below:

Title page,
Item [75], should read, -- Inventors: Asaf Schushan, Ramat Hashron; Yona Leshets, Zur Igal, both of (IL) --

Signed and Sealed this

Thirteenth Day of August, 2002

*Attest:*

*Attesting Officer*

JAMES E. ROGAN
*Director of the United States Patent and Trademark Office*